US005515442A

United States Patent [19]

Dombrowski, Jr.

[11] Patent Number: 5,515,442

[45] Date of Patent: May 7, 1996

[54] MONO/STEREO SWITCHING CIRCUIT

[75] Inventor: Joseph J. Dombrowski, Jr., Hollywood, Fla. 33021

[73] Assignees: Sony Corporation, Tokyo, Japan; Sony Electronics Inc., Park Ridge, N.J.

[21] Appl. No.: 538,983

[22] Filed: Oct. 5, 1995

Related U.S. Application Data

[63] Continuation of Ser. No. 201,995, Feb. 25, 1994, abandoned.

[51] Int. Cl.[6] ..... H04H 5/00

[52] U.S. Cl. ..... 381/11; 381/1; 381/81; 381/80

[58] Field of Search ..... 381/81, 80, 24, 381/1, 11, 28

[56] References Cited

U.S. PATENT DOCUMENTS 5,161,198 11/1992 Noble ..... 381/28

*Primary Examiner*—Jason Chan
*Assistant Examiner*—Minsun Oh
*Attorney, Agent, or Firm*—Ronald P. Kananen

[57] ABSTRACT

A mono/stereo switching circuit wherein first, second, and third switches operate in circuit which is arranged so that (1) when the first switch is engaged, and the mono/stereo switch is engaged, the signal at a first mono input is provided to both of a pair of left and right output channels; (2) when the second switch is engaged and the mono/stereo switch is not engaged, the signal at a second mono input is provided to both of the pair of left and right output channels; and (3) when the input signal is a stereo signal at the first and second inputs, and either of the first and second switches is engaged, and the mono/stereo switch is engaged, the input signal at the first input terminal is provided at the left channel output while the input signal at the second input terminal is provided at the right channel output.

11 Claims, 2 Drawing Sheets

| INPUT SIGNAL | FIRST SWITCH 13 | SECOND SWITCH 14 | THIRD SWITCH 15 | OUTPUT |
|---|---|---|---|---|
| MONO AT 11 | ENGAGED | | NOT ENGAGED | BOTH 17, 18 |
| MONO AT 12 | | ENGAGED | NOT ENGAGED | BOTH 17, 18 |
| STEREO AT 11, 12 | EITHER 13 OR 14 ENGAGED | EITHER 13 OR 14 ENGAGED | ENGAGED | SIGNAL 11 AT 17<br>SIGNAL 12 AT 18 |

EXTERNAL INPUT SELECT

MONO/STEREO SWITCHING CIRCUIT

This application is a continuation of application Ser. No. 08/201,995 filed Feb. 25, 1994 now abandoned.

BACKGROUND OF THE INVENTION

This invention relates generally to audio circuits. More particularly, this invention relates to a mono/stereo switching circuit for multiple inputs. Still more particularly, this invention relates to such a mono/stereo switching circuit which operates so that when the source signal is at only one input of at least a pair of inputs, that source signal is provided at both left and right output channels, but when the source signal is a stereo signal at two inputs, that source signal is respectively provided at both of the left and right output channels, thus providing flexibility in switching between monaural and stereo inputs.

In both consumer and professional audio equipment, a pair of input terminals among a plurality of input terminals may be arranged respectively to receive audio input signals. Those input signals may be monaural ("mono") signals, wherein one of the pair of input terminals receives the mono input signal, or stereo signals wherein the pair of input terminals receives the stereo input signals. A number of arrangements are known to the prior art for utilizing those signals to provide mono and/or stereo output signals respectively. Specifically, it is desired that when the source signal is provided at one input, that signal is provided to both of the left and right output channels and that when the source signal is a stereo signal provided at both inputs, that signal is provided to both of the output channels so that the left input signal is provided at the left output channel, while the right input signal is provided at the right output channel.

It is thus a general and overall aim of this invention to provide a convenient and easily used mono/stereo switching circuit for providing monaural and stereo outputs depending on the state of switches in the switching circuit and the nature of the input signals at an input pair of terminals, as noted above.

These and additional aims and objectives will be apparent to those skilled in the art from a detailed review of the specification which follows taken in conjunction with the accompanying drawings.

BRIEF SUMMARY OF THE INVENTION

Directed to achieving the foregoing objectives and aims, and providing a convenient mono/stereo switching circuit, the invention in one aspect relates to a mono/stereo switching circuit, comprising a first input terminal for receiving a first input signal; a second input terminal for receiving a second input signal; a first switch in circuit with both of the first and the second input terminals for selectively receiving the first and the second input signals; a second switch in circuit with both of the first and the second input terminals for selectively receiving the first and the second input signals; and a mono/stereo select third switch for selectively receiving either or both of the first and the second input signals at a pair of (left and right) output channels, wherein the first, the second, and the third switches operate in the circuit which is arranged so that (1) when the first switch is engaged and the mono/stereo switch is engaged, the signal at the first mono input is provided to both of the left and the right output channels; (2) when the second switch is engaged and the mono/stereo switch is not engaged, the signal at the second input is provided to both of the left and right output channels; and (3) when the input signal is a stereo signal at the first and second input terminals and either of the switches is engaged, and the mono/stereo switch is engaged, the input signal at the first input terminal is provided at the left channel output while the input signal at the second input terminal is provided at the right channel output.

The circuit is also arranged so that engagement of the first, the second, and the third switches is controlled by a microprocessor. The circuit includes input terminals wherein the first input terminal comprises an EXT 1 HI input terminal and an EXT 1 LO input terminal, and the second input terminal comprises an EXT 2 HI and an EXT 2 LO input terminal, the outputs from each of the input terminals being provided to each of the first and the second switches.

The output from the first and the second switches includes MONO HI, MONO LO, LEFT HI, LEFT LO, RIGHT HI, and RIGHT LO signals which are selectively provided to the right and the left output channels as a function of the signals on the input terminals. As an alternative, circuit isolation means are provided between the input terminals and the first and the second switches.

In another aspect, the mono/stereo switching circuit according to the invention comprises a first input pair of terminals, for receiving a first input signal; a second input pair of terminals, for receiving a second input signal; a first multiple connector switch in circuit with the first input pair of terminals; a second multiple connector switch in circuit with the second input pair of terminals; the first and the second multiple connector switches being connected so that the first input pair of terminals is also in circuit with the second multiple connector switch when the first switch is not engaged and with an output from the first switch when the first switch is engaged, and the second input pair of terminals is also in circuit with the multiple connector switch when the first switch is not engaged with an output from the second switch when the second switch is engaged; and a mono/stereo third select switch in circuit with outputs of the first and the second switches, for selectively providing, in cooperation with the positioning of the first and the second switches, any one of a monaural output at both of the right and left output channels representative of an input at said first input pair of terminals, a monaural output at both of the right and left output channels representative of an input at the second input pair of terminals, and a stereo output at both of the right and the left output channels representative of inputs at both of the first and the second input pair of channels. The circuit is arranged so that the first, the second, and the third switches operate in the circuit which is arranged so that (1) when the first switch is engaged, and the mono/stereo switch is engaged, the signal at the first mono input is provided to both of the left and the right output channels; (2) when the second switch is engaged and the mono/stereo switch is not engaged, the signal at the second input is provided to both of the left and right output channels; and (3) when the input signal is a stereo signal at the first and second inputs, and either of the switches is engaged, and the mono/stereo switch is engaged, the input signal at the first input terminal is provided at the left channel output while the input signal at the second input terminal is provided at the right channel output.

BRIEF DESCRIPTION OF THE DRAWINGS

In the drawings:

FIG. 1 is a diagrammatic illustration of the circuit according to the invention;

DETAILED DESCRIPTION OF THE PREFERRED EMBODIMENT

Figure 2:
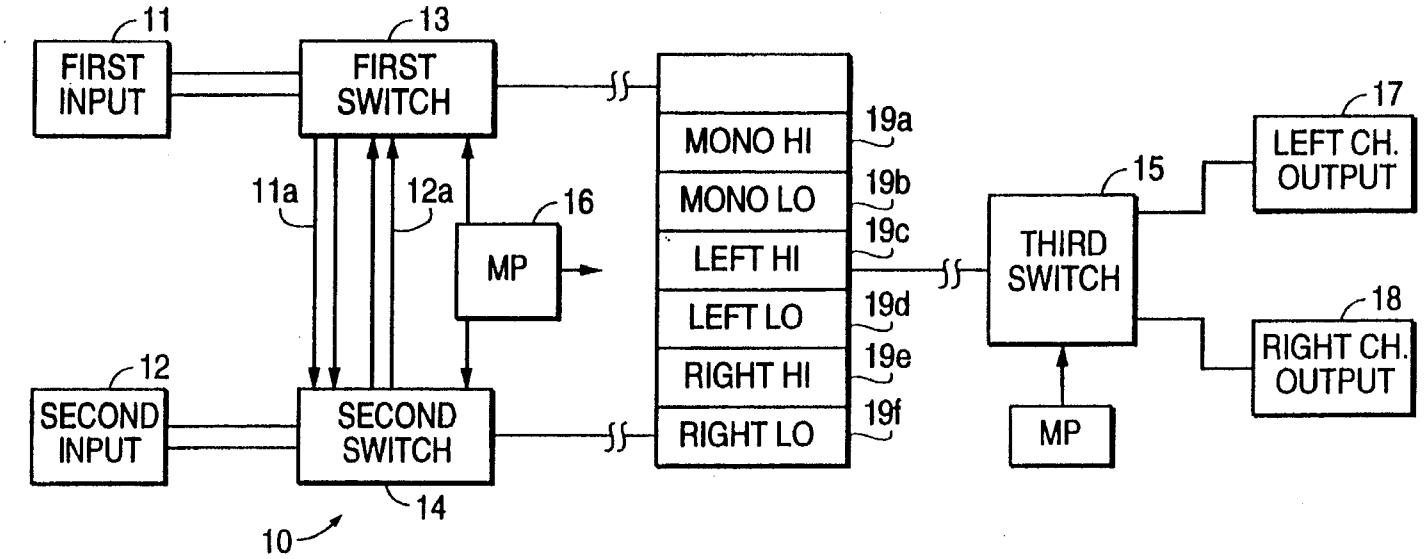
FIG. 2 is a truth table of the operation of the circuit of FIG. 1.

In FIG. 1, a diagrammatic illustration of the mono/stereo circuit according to the invention is shown generally at the reference numeral 10. The circuit 10 includes a first mono input 11, a second mono input 12, a first switch 13, a second switch 14, and a third mono/stereo switch 15. The circuit 10 is arranged so that when the first switch 13 is engaged, and the mono/stereo switch 14 is not engaged, the signal at the first mono input 11 is provided to both of the left and the right output channels 17 and 18, respectively. When the second switch 14 is engaged and the mono/stereo switch 15 is not engaged, the signal at the second input 12 is provided to both of the left and right output channels 17, 18. When the input signal is a stereo signal at the first and second inputs 11, 12, and either of the switches 13 and 14 is engaged, and the mono/stereo switch 15 is engaged, the input signal at the first input terminal 11 is provided at the left output channel 17 while the input signal at the second input terminal 12 is provided at the right output channel 18.

In FIG. 1, the switches 13, 14, and 15 may be manually operated according to the nature of the input signals at the first and second input terminals 11, 12, as seen or sensed by instruments available to an operator. In the alternative, the switches may be programmed by a microprocessor 16 based upon a logical interpretation or sensing of the location of the input signals. For example, if an input signal were sensed at the first input circuit 11, but none was sensed at the second input circuit 12, the microprocessor 16 could representatively operate to engage the switch 13, while allowing the switches 14 and 15 to remain unengaged. The microprocessor 16 could thus follow the logical scheme discussed above to control the switches 13, 14, and 15 according to the input signals, or as a part of a larger, more comprehensive control scheme.

The signals output from the switches 13, 14 are shown as MONO HI, MONO LO, LEFT HI, LEFT LO, RIGHT HI, and RIGHT LO respectively on leads 19*a* through 19*f*. As will be seen in FIG. 3 and understood from the description of FIG. 3, the switches 13 and 14 are interrelated so that the input from the mono input 11 is also provided to the switch 14 on leads 11*a*, while the input from the mono input 12 is also provided to the switch 13 on leads 12*a*. Through this interconnection, the signal at the input circuit 11 can be provided to both output channels 17, 18; the signal at the input circuit 12 can be provided to both output channels 17, 18; and the signals at both input circuits 11, 12 can be provided respectively to the output channels 17, 18.

Figure 3:
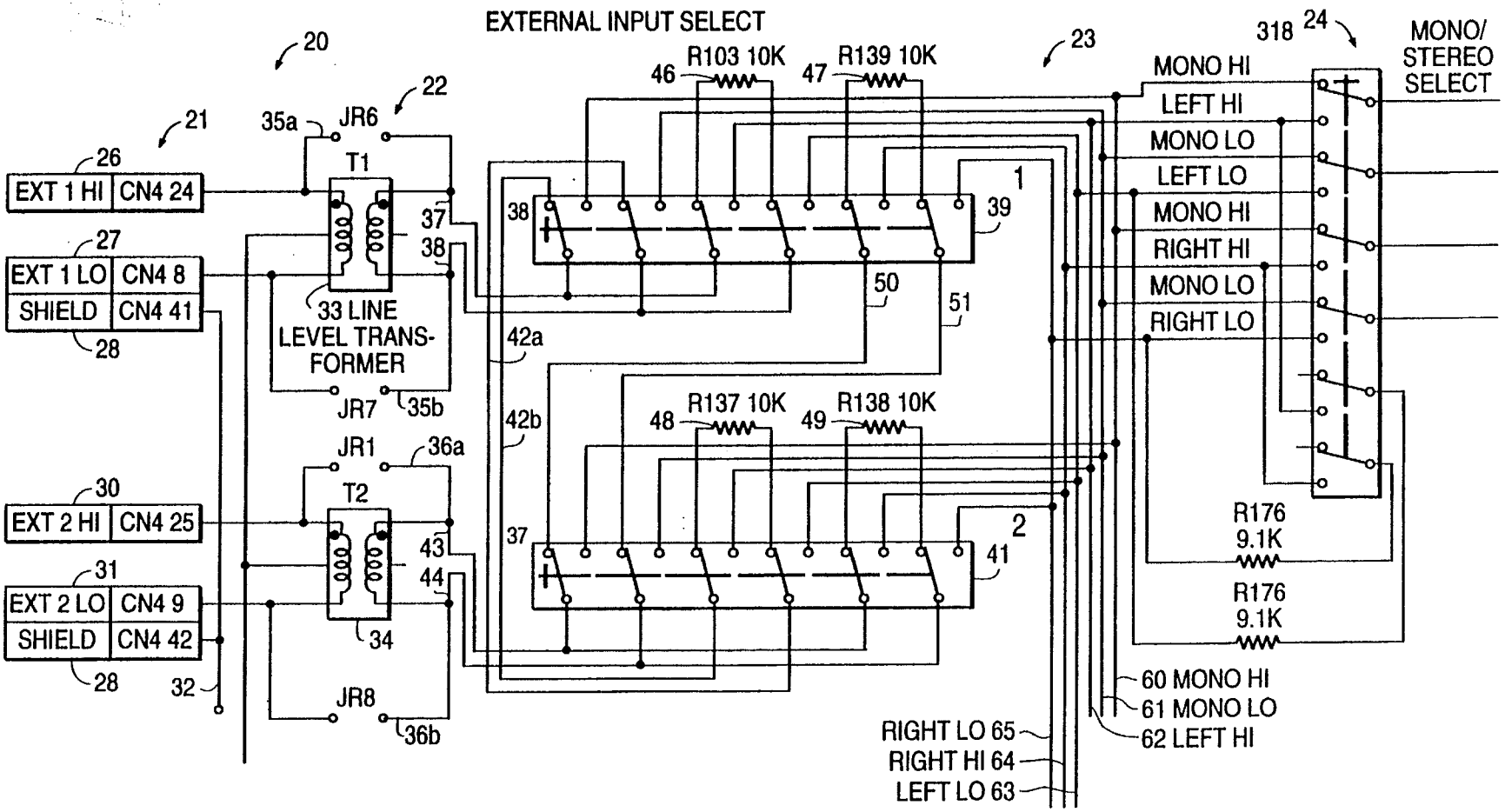
FIG. 3 is a more detailed schematic of a preferred embodiment of the circuit according to the invention.

FIG. 2 is a representative truth table for the operation of the circuit of FIG. 1 which is also applicable to the circuit of FIG. 3.

In FIG. 3, a preferred embodiment of the mono/stereo switching circuit according to the invention is designated generally by the reference numeral 20. The mono/stereo switching circuit 20 includes an input circuit designated generally by the reference numeral 21 providing an input to an optional isolation circuit 22 which in turn provides inputs to an external input select switching circuit 23, the output of which is provided to a mono/stereo select switching circuit 24.

The input circuit 21 includes a mono external input pair of terminals 26, 27 which may be representative of a left channel monaural ("mono") input and which are shielded by a shield input 28. The terminal input 26 is designated EXT 1 HI, while the input terminal 27 is designated EXT 1 LO, which together provide an input signal representative of a monaural external input signal. Similarly, the input circuit 21 also includes a mono external input pair of terminals 30, 31 which may be representative of a right channel monaural input and which are also shielded by the input shield 28. The terminal input 30 is designated EXT 2 HI, while the input terminal 31 is designated EXT 2 LO. The input shields 28 are connected by a lead 32 to a source of reference potential, such as ground (not specifically shown).

The outputs from the terminal pairs 26, 27 and 30, 31 respectively are provided to the inputs of an isolation circuit 22 which comprises a pair of line level isolation transformers 33, 34, each of which includes input and output windings. The leads 35*a* and 35*b* are provided to bypass the isolation transformer 37 if desired by connecting the open terminals which are shown. The input windings of the transformer 33 are respectively connected to the terminal pair 26, 27, while the input windings of the transformer 34 are connected to the terminal pair 30, 31. The output windings of the transformer 33 provide the input on leads 37, 38 to a first multiple connector switch 39 shown in its non-engaged position. As shown, the input terminals are thus in circuit with a terminating resistor 47 on switch 39 and with a terminating resistor 40 on switch 41 by way of leads 42*a*, 42*b*.

Similarly, the output windings of the transformer 34 provide the input on leads 43, 44 through the second switch 41 in circuit with a terminating resistor 47 by way of leads 50, 51 in parallel with the resistor 48 connected to the switch 41.

The outputs from the switches 39 and 41 are ganged to selectively provide signals representative of MONO HI, MONO LO, LEFT HI, LEFT LO, RIGHT HI, and RIGHT LO which provide the inputs designated respectively by the numerals 60 to 65 to the mono/stereo select switch 24 through inputs designated respectively as MONO HI, LEFT HI, MONO LO, LEFT LO, MONO HI, RIGHT HI, MONO LO, and RIGHT LO. The switch 24 is also shown in its non-engaged position.

In operation, the circuit of FIG. 3 can be operated in three separate modes: (1) a MONO EXT 1 mode for receiving signals at the input terminals 26, 27 wherein the first switch 39 is engaged, the second switch 41 is not engaged, and third switch 24 is not engaged, and the signals at terminals 26, 27 are thus provided to both output channels; (2) a MONO EXT 2 mode for receiving signals at the input terminals 30, 31 wherein the first switch 39 is not engaged, the second switch 41 is engaged, and the third switch 24 is not engaged, and the signals at the terminals 30, 31 are thus provided to both output channels; and (3) either the first switch 39 or the second switch 41 is engaged, and the third switch 24 is engaged, a stereo output is provided wherein the signal at the terminals 26, 27 are provided at the left output channel, and the signals at the terminals 30, 31 are provided at the right output channel.

These and other modifications and alterations of the disclosure may be made within the spirit of the invention which is determined by the scope of the appended claims.

What is claimed is:

1. A mono/stereo switching circuit, comprising:

a first input terminal for receiving a first input signal;

a second input terminal for receiving a second input signal;

a first switch in circuit with both of said first and said second input terminals for selectively receiving said first and said second input signals;

a second switch in circuit with both of said first and said second input terminals for selectively receiving said first and said second input signals; and a mono/stereo select third switch for selectively providing either or both of said first and said second input signals as a pair of output channels, wherein said first, said second, and said third switches are arranged so that (1) when the first switch is engaged, and the mono/stereo switch is not engaged, the first input signal is provided to both of the pair of output channels; (2) when the second switch is engaged and the mono/stereo switch is not engaged, the second input signal is provided to both of the pair of output channels; and (3) when the first input signal and the second input signal together comprise a stereo signal, either of the first switch and the second switch is engaged, and the mono/stereo switch is engaged, the input signal is provided as one of said pair of output channels while the input signal as the second input terminal is provided at the other of said pair of output channels.

2. The circuit as set forth in claim 1 wherein engagement of said first, said second, and said third switches is controlled by a microprocessor.

3. The circuit as set forth in claim 1 wherein said first input terminal comprises an EXT 1 HI input terminal and an EXT 1 LO input terminal; said second input terminal comprises an EXT 2 HI and an EXT 2 LO input terminal, the outputs from each of said input terminals being provided to each of said first and said second switches.

4. The circuit as set forth in claim 3 wherein the output from said first and said second switches includes MONO HI, MONO LO, LEFT HI, LEFT LO, RIGHT HI, and RIGHT LO signals which are selectively provided to said pair of output channels as a function of the signals on the input terminals.

5. The circuit as set forth in claim 1 wherein circuit isolation means are provided between said input terminals and said first and said second switches.

6. A mono/stereo switching circuit, comprising:

a first input pair of terminals, for receiving a first input signal;

a second input pair of terminals, for receiving a second input signal;

a first multiple connector switch in circuit with said first input pair of terminals;

a second multiple connector switch in circuit with said second input pair of terminals; and a mono/stereo third select switch which provides a two channel output;

wherein said first and said second multiple connector switches are connected so that said first input signal is provided to said second multiple connector switch when said first switch is not engaged and said first input signal is provided to said mono/stereo third switch when said first switch is engaged, and wherein said second input signal is provided to said first multiple connector switch when said second switch is not engaged and said second input signal is provided to said mono/stereo third switch is engaged; and wherein said mono/stereo third select switch selectively provides, in cooperation with the positioning of said first and said second switches, any one of: (1) a monaural output at both said two channel output which is representative of said first input signal received at said first input pair of terminals, (2) a monaural output at said two channel output which is representative of said second input signal received at said second input pair of terminals, and (3) a stereo output at said two channel output which is representative of said first input signal and said second input signal received at both of said first and said second respectively input pair of terminals.

7. The circuit as set forth in claim 6, wherein said first, said second, and said third switches are arranged so that (1) when the first switch is engaged, and the mono/stereo switch is not engaged, the first input signal is provided to both channels of said two channel output; (2) when the second switch is engaged and the mono/stereo switch is not engaged, the second input signal is provided to both channels of said two channel output; and (3) when the first input signal and the second input signal together comprise a stereo signal, either of the first switch and the second switch is engaged, and the mono/stereo switch is engaged, the first input signal is provided as a left channel output while the second input signal is provided as a right channel output.

8. The circuit as set forth in claim 6 wherein engagement of said first, said second, and said third switches is controlled by a microprocessor.

9. The circuit as set forth in claim 6 wherein said first input terminal comprises an EXT 1 HI input terminal and an EXT 1 LO input terminal; said second input terminal comprises an EXT 2 HI and an EXT 2 LO input terminal, the outputs from each of said input terminals being provided to each of said first and said second switches.

10. The circuit as set forth in claim 6 wherein the output from said first and said second switches includes MONO HI, MONO LO, LEFT HI, LEFT LO, RIGHT HI, and RIGHT LO signals which are selectively provided to said right and said left output channels as a function of the signals on the input terminals.

11. The circuit as set forth in claim 6 wherein circuit isolation means are provided between said input terminals and said first and said second switches.

* * * * *